United States Patent [19]

Brdlik

[11] Patent Number: 4,834,261

[45] Date of Patent: May 30, 1989

[54] PAINT STORING SYSTEM

[76] Inventor: Karl Brdlik, 1 St. Crispins Drive, Scarborough, Ontario, Canada, M1T 2V9

[21] Appl. No.: 155,812

[22] Filed: Feb. 16, 1988

[51] Int. Cl.[4] ..... B65D 6/00; B65D 25/16

[52] U.S. Cl. ..... 220/404; 141/319; 141/331; 141/364; 220/23.83; 220/403

[58] Field of Search ..... 141/106, 319, 331, 363, 141/364; 220/23.83, 23.86, 403, 404

[56] References Cited

U.S. PATENT DOCUMENTS

| | | | |
|---|---|---|---|
| 773,960 | 11/1904 | Moore | 141/331 |
| 816,989 | 4/1906 | Moler et al. | 220/404 |
| 950,552 | 3/1910 | Milholland et al. | 141/331 |
| 996,127 | 6/1911 | Patnaude | 141/363 |
| 2,767,744 | 10/1956 | Beerman | 141/364 |
| 3,184,100 | 5/1965 | Thomas | 220/404 |
| 3,248,016 | 4/1966 | Dahl et al. | 141/319 |
| 3,818,956 | 6/1974 | Chamberlain | 220/404 |
| 4,340,095 | 7/1982 | Dale et al. | 141/319 |
| 4,600,125 | 7/1986 | Maynard, Jr. | 141/331 |

FOREIGN PATENT DOCUMENTS

| | | | |
|---|---|---|---|
| 0713906 | 7/1965 | Canada | 220/404 |
| 0997675 | 7/1965 | United Kingdom | 220/404 |

*Primary Examiner*—Jimmy G. Foster
*Attorney, Agent, or Firm*—Sim & McBurney

[57] ABSTRACT

A system for storing paint which might otherwise be left in partially-emptied paint can includes a bag holder with an opening. A plastic bag is maintained in an open orientation within the bag holder. A lid having a central lid portion defining a funnel is fitted over the container opening with the funnel extending into the container towards the open bag. A circumferential shoulder extends upwardly about central lid portion and ensures that the can is properly located over the funnel portion when seated in an open and inverted orientation. Paint is drained over a period of time into the plastic bag which can then be closed to store the paint.

3 Claims, 2 Drawing Sheets

PAINT STORING SYSTEM

FIELD OF THE INVENTION

The invention relates to methods and apparatus for storing paint once a paint can has been opened.

DESCRIPTION OF THE PRIOR ART

Paint is commonly sold in standard-size paint cans. During use, paint commonly drips down the can, obscuring any information regarding the nature of the paint contained. Also, the container is sometimes improperly sealed after use or a substantial quantity of air remains in the can causing the contained paint to desiccate and form a surface skin. Many householders will note that they tend to accumulate partially-filled cans of paint, but that they commonly purchase fresh paint each time paint is required, making a special effort to match existing colours.

BRIEF SUMMARY OF THE INVENTION

In one aspect, the invention provides a system for storing paint remaining in an open paint can. The system comprises a bag container, and a plastic bag maintained in an open orientation in the bag container. A lid is provided which has a central lid portion including a funnel portion with a funnel outlet, seating structure which cooperates with the container to locate the lid over a container opening such that the funnel portion extends downwardly towards the interior of the container and the contained bag, and a circumferential shoulder extending upwardly from the lid portion and dimensioned such that the paint can is maintained by the shoulder centrally over the funnel portion when seated in an open and inverted orientation on the central lid portion. Once the paint remaining in the can has been allowed to drip completely into the bag, the bag may be closed with a twist-tie, knot or other appropriate fastener, forcing air from the bag during closure to reduce paint desiccation, and then appropriately labeled before storing the paint if desired.

In other aspects, the invention provides components such as a lid structure or combination lid and container appropriate for use in such a paint storing system. Various aspects of the invention will be apparent from a description of a preferred embodiment below and will be more specifically identified in the appended claims.

DESCRIPTION OF THE DRAWINGS

The invention will be better understood with reference to drawings in which.

DESCRIPTION OF PREFERRED EMBODIMENT

Figure 1:
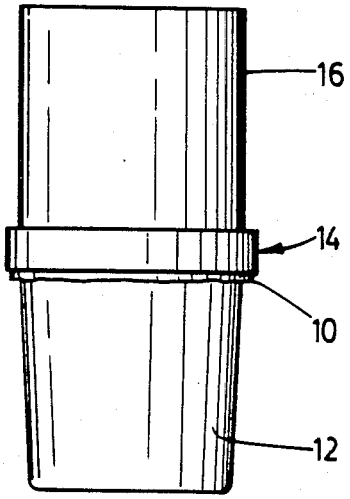
FIG. 1 is an perspective view of a paint saving system embodying various aspects of the invention, in an operative orientation.
Figure 2:
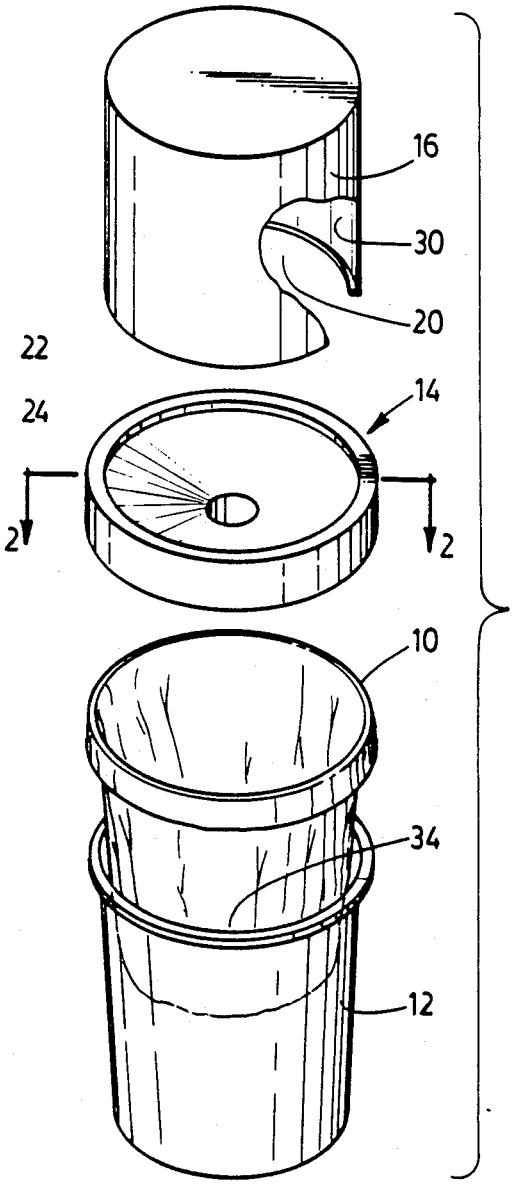
FIG. 2 is an exploded perspective view of the components of the paint saving system.

Reference is made to FIGS. 1 and 2 which illustrate the principal components of a paint storing system including a transparent plastic bag 10, a bag container 12 whose principal function is to maintain the bag 10 in an open orientation (as illustrated), and a lid 14 which directs paint from an inverted paint can 16 to the bag 10.

The paint can 16 is of a standard predetermined size with a rim of predetermined diameter and radial thickness surrounding the paint can opening 20. The paint can 16 will normally be seated in an inverted and open orientation on the lid 14 when paint is being transferred from the paint can 16 to the bag 10.

Figure 3:
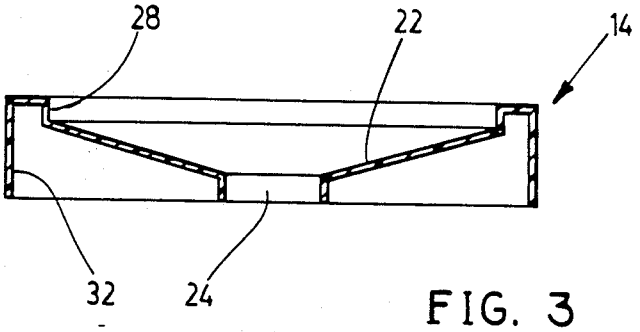
FIG. 3 is a cross-sectional view along the lines 3—3 of FIG. 2 detailing the construction of a lid; and, FIG. 4 is a perspective view showing the results of using the system, namely, paint stored in a bag in such a manner that the colour of the paint can be identified and excess air is excluded.

The lid 14 has a central lid portion defining a funnel with a broad funnel outlet 24. A circumferential shoulder 28 extends upwardly from about the central lid portion 22 and is dimensioned slightly larger than the outer diameter of the paint can sidewall 30 so that the paint can 16 is properly located and maintained on the central lid portion 22 when seated in the open and inverted orientation apparent in FIGS. 1 and 2. The lid 14 also has seating structure, namely, a downwardly-extending circumferential sidewall 32 (specifically indicated in the cross-sectional view of FIG. 3), which cooperates with the container 12 to properly locate the lid 14 over the container opening 34. Specifically, the circumferential lid sidewall 32 extends downwardly about a circumferential and outwardly-directed lip associated with the container rim surrounding the opening 34. In this orientation, the funnel and funnel outlet 24 extend downwardly towards the interior of the container 12 and the interior of the bag 10 for proper deposition of paint into the bag 10. The exact lid seating structure is not a critical aspect of the present invention nor is the exact configuration of the bag container 12.

Figure 4:
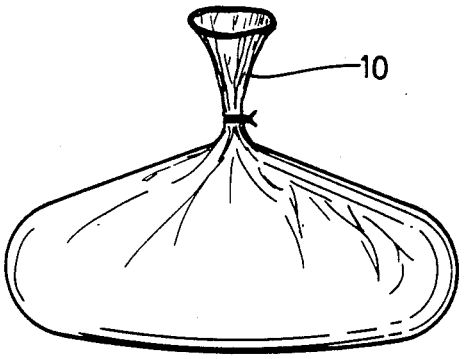

Once paint has been drained into the bag 10, the bag 10 may then be closed with a tie or knot and removed from the container as in FIG. 4. Before closing the bag 10 steps should be taken to force air from the bag 10 in order to reduce paint drying and the formation of a film over the top of the paint. The bag 10 is a laminate film bag with an outer layer of nylon that is exposed to the stored paint and is appropriate for both latex-based and oil-based paints. Conventional polyethylene bags are expected to be inappropriate for storage of oil-based paints.

It will be appreciated that a particular embodiment of the invention has been described and that modifications may be made therein without departing from the spirit of the invention or necessarily departing from the scope of the appended claims.

I claim:

1. A system for storing paint remaining in an open paint can, comprising:

a container with an opening;

a plastic bag maintained in an open orientation in the bag container;

a lid having a central lid portion including a funnel portion with a funnel outlet, seating structure means co-operating with the container for locating the lid over the container opening such that the funnel portion extends downwardly towards the interior of the container and the interior of the bag, and a circumferential shoulder extending upwardly from the central lid portion and dimensioned such that the paint can is maintained by the shoulder centrally over the funnel portion when seated in an open and inverted orientation on the central lid portion within the circumferential shoulder.

2. A system as claimed in claim 1 in which the seating structure means comprise a circumferential downwardly-extending sidewall dimensioned for location about the container.

3. A system as claimed in claim 1 in which the plastic bag has a nylon surface for exposure to the paint.

* * * * *